United States Patent [19]

Baron et al.

[11] 4,082,520

[45] * Apr. 4, 1978

[54] PROCESS OF PRODUCING GASES HAVING A HIGH CALORIFIC VALUE

[75] Inventors: Gerhard Baron, Hofheim; Herbert Bierbach; Carl Hafke, both of Frankfurt am Main; Günter Pockrandt, Bad Homburg, all of Germany

[73] Assignee: Ruhrgas Aktiengesellschaft, Essen, Germany

[ * ] Notice: The portion of the term of this patent subsequent to Nov. 1, 1994, has been disclaimed.

[21] Appl. No.: 704,709

[22] Filed: Jul. 12, 1976

[30] Foreign Application Priority Data

Jul. 18, 1975 Germany ..... 2532198

[51] Int. Cl.[2] ..... C10J 3/16

[52] U.S. Cl. ..... 48/202; 48/197 R; 48/206; 260/449 M

[58] Field of Search ..... 48/202, 206, 210, 197 R, 48/214 A, 200, 201, 65; 252/373; 260/449 M

[56] References Cited

U.S. PATENT DOCUMENTS

| | | | |
|---|---|---|---|
| 2,094,027 | 9/1937 | Stitzer | 48/65 |
| 2,687,950 | 8/1954 | Kalbach | 48/202 |
| 3,368,982 | 2/1968 | Milbourne | 48/214 A |
| 3,379,505 | 4/1968 | Holmes et al. | 48/214 A |
| 3,384,467 | 5/1968 | Ammann et al. | 48/65 |
| 3,890,113 | 6/1975 | Child et al. | 260/449 M |
| 3,927,997 | 12/1975 | Child et al. | 260/449 M |
| 3,951,617 | 4/1976 | Crouch | 48/197 R |
| 3,957,681 | 5/1976 | Tomita et al. | 48/214 A |

*Primary Examiner*—Robert L. Lindsay, Jr.
*Assistant Examiner*—George C. Yeung
*Attorney, Agent, or Firm*—Burgess, Dinklage & Sprung

[57] ABSTRACT

In the production of a gas having a high calorific value and containing more than about 50% methane by volume by a process comprising gasifying a solid fuel under a pressure of about 5 – 150 bars by a treatment with oxygen and water vapor to produce a water vapor-containing raw gas at a temperature of about 350°– 700° C, the improvement which comprises further reacting the water vapor-containing raw gas under a pressure of about 5 – 150 bars with oxygen in a succeeding reactor to produce an intermediate product gas which contains mainly hydrogen, carbon dioxides, and methane and which leaves the reactor at a temperature between about 600° and 950° C, cooling the intermediate product gas and freeing the intermediate product gas from sulfur compounds. A dust fuel and/or liquid hydrocarbon can be added to the raw gas as such or after prereaction with oxygen, the addition advantageously taking place in the succeeding reactor. The reactor may contain a granular bed of a catalyst such as nickel, cobalt or chromium oxide and/or sulfide, and/or a contact material or catalyst support such as an oxide, spinel or silicate of aluminum and/or magnesium. The bed can be fluidized or otherwise mechanically moved.

13 Claims, 1 Drawing Figure

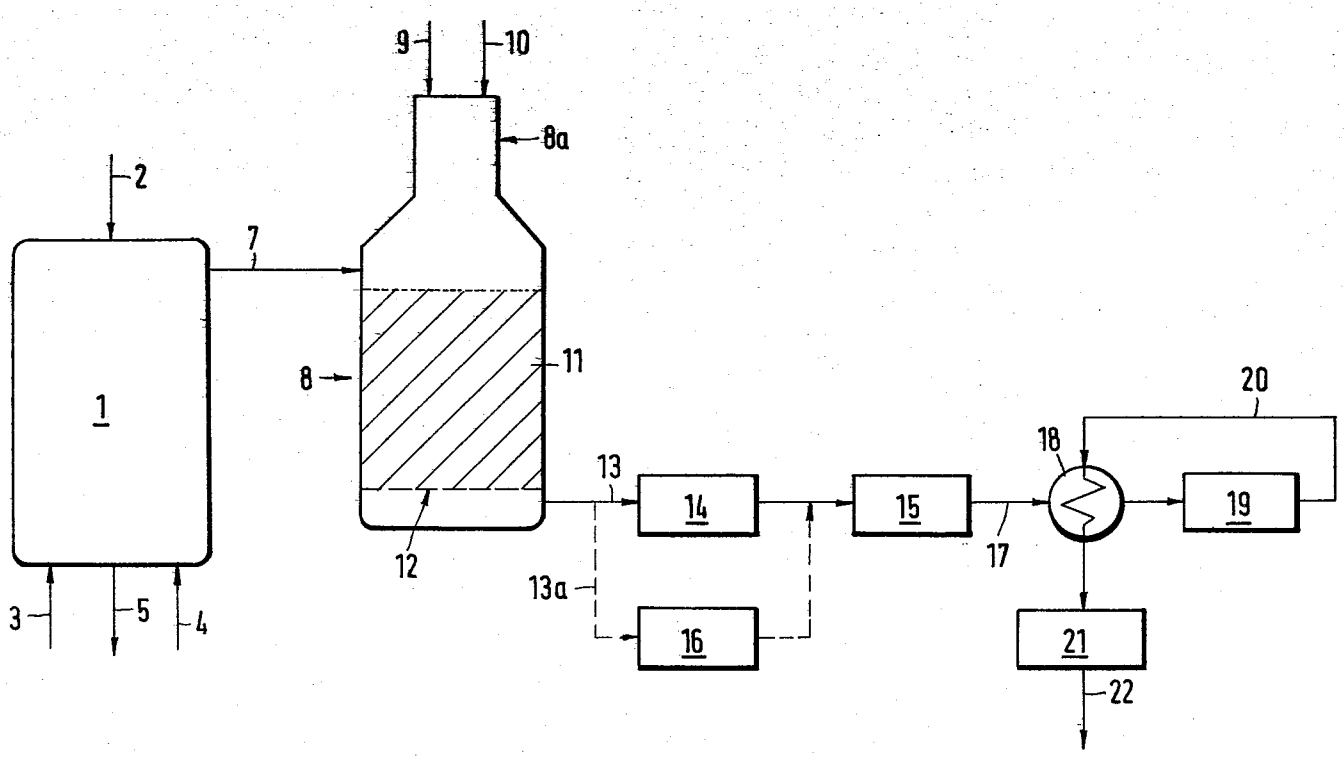
1
2
3
4
5
7
8
8a
9
10
11
12
13
13a
14
15
16
17
18
19
20
21
22

PROCESS OF PRODUCING GASES HAVING A HIGH CALORIFIC VALUE

BACKGROUND

This invention relates to a process of producing gases which have a high calorific value and contain more than 50% methane by volume by a gasification of solid fuels, particularly coal, under a pressure of about 5–150 bars by a treatment with free oxygen-containing gas and water vapor and, if desired, additional gasifying agents to produce a water vapor-containing raw gas at a temperature of about 350°–700° C.

The process is derived from known processes of gasifying coal, including brown coal. A raw gas which can be economically converted to a high methane gas can be produced particularly by the pressure gasification of coal by a treatment with oxygen and/or air and, as further gasifying agents, water vapor and possibly carbon dioxide. A pressure gasification of coal is effected under pressures of 5–150 bars, preferably about 10–80 bars, and results in a water vapor-containing raw gas at a temperature of 350°–700° C. The pressure gasification of coal is known from numerous publications, such as U.S. Pat. Nos. 3,937,620, 3,902,872, 3,540,867 and 3,854,859, and German Published Specification DOS 2,201,859, and German Published Specification DOS 2,201,278.

Coal is normally gasified under pressure by a counterflow operation in which the fuel to be gasified and the gasifying agents are fed into the reaction chamber from opposite directions and move in said chamber in opposite directions. That operation has proved desirable because the sensible heat of the product gas is advantageously utilized to heat the fuel to the reaction temperature. In the reactor or gas producer, the fuel travels through several zones. The fuel is dried first and is then degasified in a dry distillation zone before the fuel enters the gasification zone, in which a major portion of the endothermic reactions are carried out. In the combustion zone the remaining fuel is finally reacted to a large extent with the free oxygen and an incombustible residual ash consisting of mineral constituents is left. The gasifying agent which flows into the reactor receives sensible heat from that ash; this is a special advantage from the aspect of heat economy. Experience has shown that the gasifying agents are suitably supplied at a metered rate which is selected so that the maximum combustion temperatures in the reactor are below the melting point of the ash.

In addition to water vapor, the raw gas produced by the pressure gasification of coal contains mainly hydrogen and carbon oxides as well as methane. Numerous further substances, such as condensible hydrocarbons, particularly tar having various boiling ranges, are present in smaller quantities. Whereas these are often considered as valuable constituents of coal, they are not always desirable. Unless they can be directly used for the production of energy, they must be fed to a further beneficiation stage, e.g., for hydrogenation. The processing of such substances is often problematic because they become available as a result of a gasification in quantities which are not sufficient for an economical utilization. They are also undesired because they become available together with the aqueous condensate formed from the gaseous constituents during the further processing of the raw gas. A considerable expenditure is required to purify this condensate, which contains not only hydrocarbons but, inter alia, also phenols, fatty acids, and ammonia.

It is an object of the invention to enable a processing of the raw gas and its conversion to a high-methane gas in a simpler manner and at lower costs. This is accomplished in that the water vapor-containing raw gas is reacted under a pressure of about 5–150 bars with free oxygen-containing gases in a succeeding reactor to produce an intermediate product gas, which contains mainly hydrogen, carbon oxides, and methane and which leaves the reactor at temperatures between about 600° and 950° C, and this intermediate product gas is cooled and freed from sulfur compounds. As the raw gas is converted to the intermediate product gas, the hydrocarbons contained in the raw gas as well as the disturbing phenols, fatty acids, and ammonia are converted mainly to hydrogen and carbon oxides by gasification and cracking and for this reason need not be separated from the raw gas and a further treatment is avoided. The reaction to produce the intermediate product gas is suitably effected under the same pressure as the production of the raw gas.

Dust fuels, particularly coal dust, or liquid hydrocarbons, particularly tar and/or tar oil, may preferably be gasified by a treatment with oxygen before or in the reactor for producing the intermediate product gas, and the gasification products may be fed to the reaction for producing the intermediate product gas. Exhaust gases and undesired by-products of other processes can also be processed by such thermal gasification treatment with oxygen. $CO_2$ may be used as one of the gasifying agents in the production of the intermediate product gas.

The thermal gasification of the dust fuels, liquid hydrocarbons, exhaust gases or by-products by a treatment with oxygen results in reaction temperatures of about 900°–1400° C and in a production mainly of hydrogen and carbon monoxide, which subsequently deliver heat to the endothermic reactions carried out in the reactor for producing the intermediate product gas. The thermal gasification may be effected in a separate reactor or in the reactor for producing the intermediate product gas.

The dust fuels to be subjected to the thermal gasification have a particle size up to about 2 mm, preferably between about 0.03 mm and 0.3 mm. Liquid hydrocarbons to be subjected to the thermal gasification are first vaporized or formed into a fine spray. Exhaust gases which contain combustible constituents may be used as atomizing agents for dispersing the liquid hydrocarbons or dust fuels.

The reactor for producing the intermediate product gas may be designed in various ways. In the reactor, the starting materials in the form of dust and gas are suitably subjected to centrifugal forces or turbulent conditions of flow. This may be accomplished, e.g., in that the reactor contains internal fixtures or a bed of granular material having a particle size of about 3–80 mm, preferably about 5–30 mm. The granular material may consist of heat-resisting inert material, which serves primarily to agitate the gas and dust particles.

According to a further preferred feature of the process according to the invention, the reactor for producing the intermediate product gas contains catalytically acting substances, such as nickel, cobalt, chromium, or their oxides or sulfides. For this purpose, known catalysts are selected which accelerate the cracking of the gases and vapors to hydrogen and carbon oxides in the reactor for producing the intermediate product gas whereas a formation of carbon black is avoided. Supports for the catalysts may consist of $Al_2O_3$, MgO or mixtures of these two substances as well as silicates of aluminum and/or magnesium. The catalyst support may also consist of aluminum spinel or magnesium spinel. To increase the extent of the reaction in the reactor for producing the intermediate product gas, the granular bed may be carried by a movable grate. Alternatively, the bed may consist of a fluidized bed.

Because the cracking reactions in the intermediate product gas reactor are endothermic reactions, care must be taken that sufficient energy is available for the reaction. To that end, the bulk material contained in the reactor may be periodically removed from the reactor and freed from combustible residues whereafter the bulk material is returned at an elevated temperature to the reactor. At least part of the energy required for the reaction may be supplied by high-frequency fields or electric resistance heating. In most cases, however, it will be possible to supply the required energy by a partial oxidation with the oxygen which is fed.

The process according to the invention will be further described in the accompanying drawing which is a flow sheet of the process.

Referring now more particularly to the drawing, coal, e.g., hard coal or brown coal, is fed through conduit 2 to the gas-producing reactor 1 and is gasified therein. The gasifying agents consisting of water vapor and oxygen are injected through the conduits 3 and 4 into the reactor at the lower end thereof. The ash which is produced by the gasification treatment is withdrawn through conduit 5. The gasification carried out in the reactor 1 is known per se and is effected under a superatmospheric pressure of about 4–150 bars, preferably about 10–80 bars.

The water vapor-containing raw gas produced by the gasification is at temperatures in the range from about 350°–700° C when it leaves the reactor 1 through conduit 7. This raw gas may be passed through a cyclone for a coarse separation of dust, if this is required. This optional feature is not shown on the drawing. A second reactor 8 for an after-gasification of the raw gas receives the latter from conduit 7. The pressures in the reactors 1 and 8 are suitably the same.

The reactor 8 is fed at its top **8*a* with coal dust through conduit 9 and with oxygen through conduit 10. This coal dust and oxygen interreact in the reactor with production of high temperatures of about 900°–1400° C. The reaction products together with the raw gas from conduit 7 then flow through a bed 11 of inert granular material, such as $Al_2O_3$, which has a particle size up to about 2 mm, preferably about 0.03 to 0.3 mm, and is carried by a grate 12**.

The bed 11 serves mainly for an intense agitation of the fluid flowing into the bed so that the extent of reactions between the components of that flowing fluid is increased. The bed may alternatively consist of catalytically active material for intensifying the gasification reactions taking place in the reactor 8. The gasification reactions comprise reactions of solid fuels and hydrocarbons and, inter alia, phenols, fatty acids, and ammonia, with oxygen and water vapor to produce hydrogen, carbon oxides, and methane. These gasification or cracking reactions are endothermic reactions.

The reaction in the reactor 8 is so controlled that the resulting intermediate product gas is at a temperature of about 600°–950° C as it leaves the reactor. The intermediate product gas flows in conduit 13 to a scrubber-cooler 14 and is subsequently fed to a desulfurizing scrubber 15. The scrubber-cooler 14 may be replaced by one or more waste-heat boilers and/or scrubber-coolers. When a shift conversion is required, part of the intermediate product gas is branched off through the conduit **13*a*, represented by a dotted line, and fed to a shift converter 16, in which $CO + H_2O$ are catalytically converted to $CO_2 + H_2$ in known manner, e.g., in accordance with U.S. Pat. No. 3,069,250. The shift-converted gas is admixed with the main stream flowing in conduit 17 before it is fed to the desulfurizer 15**.

The desulfurization in the scrubber 15 may also be carried out in known manner, e.g., by the Rectisol process, in which the gas is scrubbed with scrubbing agents such as methanol at temperatures below about 0° C to remove impurities, mainly sulfur compounds and carbon dioxide. Such scrubbing processes have been described in U.S. Pat. Nos. 2,863,527; 3,531,917; and 3,710,546. The thus purified gas leaves the scrubber 15 in conduit 17 and is reheated to temperatures of about 250°–350° C in the heat exchanger 18. The gas then flows into a plant 19 for catalytic methanation. In this plant, which is also known (U.S. Pat. No. 3,511,624 and British Patent 820,257) methane and water vapor are produced from carbon oxides and hydrogen.

The gas leaving the methanating plant 19 in conduit 20 is cooled in the heat exchanger 18 and may already be used as a fuel gas which contains more than about 50% methane by volume. To enrich its methane content, the gas is suitably passed through a scrubber 21, in which carbon dioxide is removed to a large extent so that a gas which has a further increased calorific value and usually contains more than about 80% methane by volume is available in conduit 22.

EXAMPLE 1

A gas producer having an average diameter of 2.6 m and operated under a pressure of 20 bars is fed with 15 metric tons (t) of coal per hour. The coal has the following composition based on water and ash-free matter:

| Proximate Analysis | |
|---|---|
| Moisture | 251.9 kg/t |
| Ash | 298.5 kg/t |
| Tar | 143.0 kg/t |
| Water removable by dry distillation | 80.3 kg/t |
| Phenols | 8.0 kg/t |
| Fatty acids | 1.8 kg/t |
| Net calorific value | 7,044.5 kcal/kg |

| Elementary Analysis of Pure Coal | |
|---|---|
| | kg/t |
| C | 762.6 |
| H | 55.8 |
| O | 157.4 |
| N | 13.2 |
| S | 10.7 |
| Cl | 0.3 |

257 Standard $m^3$ oxygen per metric ton of coal and 5.5 kg water vapor per standard $m^3$ of oxygen are fed as gasifying agents into the gas producer. Raw gas is produced at a rate of 1913 standard $m^3/h$ on a dry basis and has the following composition in percent by volume:

| | |
|---|---|
| $CO_2$ | 28.2 |
| $H_2S$ | 0.4 |
| $C_2H_4$ | 0.4 |
| CO | 20.1 |
| $H_2$ | 38.9 |
| $CH_4$ | 11.1 |
| $C_2H_6$ | 0.6 |
| $N_2+Ar$ | 0.3 |

The raw gas contains also 0.5 standard $m^3$ water vapor per standard $m^3$ dry gas. The raw gas exit temperature is 600° C.

Cooling of the raw gas to 25° C would make the following by-products available per metric ton of water- and ash-free coal:

| | | |
|---|---|---|
| Tar | 59 | kg |
| Oil | 32 | kg |
| Gasoline | 16 | kg |
| $NH_3$ | 13.6 | kg |
| Phenols | 8 | kg |
| Fatty acids | 1.8 | kg |

The raw gas is fed without cooling to an after-gasification reactor 8 and is reacted therein with 0.04 standard $m^3$ oxygen and 0.4 kg water vapor per standard $m^3$ of raw gas. About one-half of the reactor is filled with alumina balls having an average diameter of 30 mm. The reaction chamber is 2 m in diameter and the alumina balls form a bed 4 m high.

As a result of the reaction in the reactor 8, a temperature of about 1000° C is attained near the oxygen inlet. The gas leaving the reactor is at a temperature of 700° C and has the following composition in percent by volume:

| | |
|---|---|
| $CO_2$ | 32.9 |
| $H_2S$ | 0.3 |
| CO | 12.0 |
| $H_2$ | 40.8 |
| $CH_4$ | 13.3 |
| $N_2+Ar$ | 0.7 |

This intermediate product gas is free from condensible hydrocarbons and no longer contains free oxygen. The gas is cooled to 30° C in waste-heat boilers and coolers and is then desulfurized by being scrubbed with liquid methanol at about −25° C, whereby about one-half of the $CO_2$ content is also removed. The desulfurized gas is reheated to 300° C and is then methanated in contact with a catalyst which contains 50% nickel by weight on a magnesium spinel support. The methanation is effected under a pressure of 25 bars and results in a gas which has a high calorific value and contains about 62% methane by volume on a dry basis. To increase the methane content to 96% by volume of dry gas, the gas is scrubbed with hot potassium carbonate solution to remove its $CO_2$ content to a large extent.

EXAMPLE 2

0.09 Standard $m^3$ oxygen and 0.8 kg water vapor are added to the raw gas produced in accordance with Example 1 per standard $m^3$ of said raw gas, along with coal dust having a particle size of 0.03–0.3 mm at a rate of 300 kg per metric ton of the lump fuel initially fed to the gas-producing reactor 1. The coal dust has the same analysis as the coal used in Example 1.

Raw gas, oxygen, water vapor, and coal dust are reacted in a reactor 8 such as is diagrammatically shown on the drawing and has been used in Example 1. The resulting gas is at a temperature of 750° C as it leaves the reactor 8 and has the following composition in percent by volume:

| | | |
|---|---|---|
| $CO_2$ | 30.7% | by volume |
| $H_2S$ | 0.2 | by volume |
| CO | 15.6 | by volume |
| $H_2$ | 46.6 | by volume |
| $CH_4$ | 6.4 | by volume |
| $N_2+Ar$ | 0.5 | by volume |
| $H_2O$ | 0.74 | standard $m^3$ per standard $m^3$ of dry gas |

This gas is subjected to the further processing described in Example 1. The gas leaving the methanation plant has a high calorific value and contains 57.8% methane by volume of dry gas. This methane content can be increased to 96.5% by volume in that the gas is scrubbed to remove $CO_2$ to a large extent.

The oxygen employed in the foregoing examples was substantially pure but it can be supplied mixed with other gases such as nitrogen, e.g. air.

It will be appreciated that the instant specification and examples are set forth by way of illustration and not limitation, and that various modifications and changes may be made without departing from the spirit and scope of the present invention.

What is claimed is:

1. A process for the production of a gas having a high calorific value and containing more than about 50% methane by volume comprising supplying to a first reaction zone maintained under a pressure of about 5–150 bars counterflowing masses of coal and of oxygen and water vapor to produce a water vapor-containing raw gas having a temperature of about 350°–700° C, without cooling feeding said raw gas and oxygen into a second reaction zone maintained under a pressure of about 5–150 bars, said second reaction zone containing a bed of granular material of a particle size of about 3 to 80 mm and selected from the group composed of inert material and catalytic material, withdrawing from said second reaction zone an intermediate product gas having a temperature between about 600° C and 950° C, cooling said intermediate product gas, freeing it from sulfur compounds and subjecting it to methanation.

2. The process according to claim 1, including the step of adding at least one of a dust fuel and liquid hydrocarbon to the water vapor-containing raw gas prior to its further reaction in the second zone.

3. The process according to claim 1, including the step of contacting at least one of a dust fuel and liquid hydrocarbon with oxygen in a reaction chamber, and mixing the reaction product with the water vapor-containing raw gas prior to its further reaction in the second zone.

4. A process according to claim 2, wherein the dust fuel has a particle size up to about 2mm.

5. A process according to claim 2, wherein a liquid hydrocarbon is vaporized or formed into a fine spray in which form it is added to the water-vapor containing raw gas.

6. The process according to claim 1, wherein an exhaust gas comprising combustible material is fed to the first reactor.

7. A process according to claim 6, wherein the exhaust gas is used as an atomizing agent for dispersing a liquid hydrocarbon or dust fuel which is added to the reactor.

8. The process according to claim 1, wherein the bed contains at least one oxide or sulfide or nickel, cobalt or chromium.

9. The process according to claim 1, wherein the bed contains at least one of an oxide, spinel or silicate of at least one of aluminum and magnesium.

10. The process according to claim 1, wherein the bed is mechanically moved.

11. The process according to claim 1, wherein the bed is maintained in a fluidized state.

12. The process according to claim 1, wherein the granular bed material is periodically removed from the second reactor, is freed from combustible residues and is returned at elevated temperature into the second reactor.

13. The process according to claim 1, wherein at least part of the heat of second reaction required in the reactor for producing the intermediate product gas is supplied by a high-frequency electric field or by electric resistance heating.

* * * * *

UNITED STATES PATENT AND TRADEMARK OFFICE

CERTIFICATE OF CORRECTION

PATENT NO. : 4,082,520

DATED : April 4, 1978

INVENTOR(S) : Gerhard Baron et al

It is certified that error appears in the above-identified patent and that said Letters Patent are hereby corrected as shown below:

Title Page:

In the "Assignee" [73] add
-- and Metallgesellschaft Aktiengesellschaft,
Frankfurt am Main, Germany,
a part interest to each. --

Signed and Sealed this

*Fifteenth* Day of *August 1978*

[SEAL]

*Attest:*

RUTH C. MASON
*Attesting Officer*

DONALD W. BANNER
*Commissioner of Patents and Trademarks*